US006716099B2

(12) United States Patent
Pfleiderer et al.

(10) Patent No.: US 6,716,099 B2
(45) Date of Patent: Apr. 6, 2004

(54) CONTAMINANT CONTAINMENT STRUCTURE FOR VENTILATION SYSTEMS

(75) Inventors: Donald F. Pfleiderer, St. Paul, MN (US); Leland R. Gute, Brooklyn Park, MN (US)

(73) Assignee: Enviromatic Corporation of America, Inc., Minneapolis, MN (US)

( * ) Notice: Subject to any disclaimer, the term of this patent is extended or adjusted under 35 U.S.C. 154(b) by 0 days.

(21) Appl. No.: 10/185,642

(22) Filed: Jun. 28, 2002

(65) Prior Publication Data

US 2004/0002297 A1 Jan. 1, 2004

(51) Int. Cl.[7] ..... F23L 17/14
(52) U.S. Cl. ..... 454/41; 52/199
(58) Field of Search ..... 454/356, 358, 454/16, 41; 52/199, 198

(56) References Cited

U.S. PATENT DOCUMENTS

| | | | | | |
|---|---|---|---|---|---|
| 3,393,497 | A | | 7/1968 | Donnelly | 55/439 |
| 3,907,525 | A | * | 9/1975 | King | 96/53 |
| 3,960,063 | A | * | 6/1976 | Siemes et al. | 454/355 |
| 4,036,120 | A | * | 7/1977 | Burtenshaw | 454/34 |
| 4,506,655 | A | | 3/1985 | Kuechler | 126/299 |
| 4,526,091 | A | * | 7/1985 | Sharp | 454/254 |
| 4,635,617 | A | | 1/1987 | Simonsen | 126/299 |
| 4,869,236 | A | | 9/1989 | Blough | 126/299 |
| 4,987,882 | A | | 1/1991 | Kaufman | 126/299 |
| 5,196,040 | A | | 3/1993 | Malloy et al. | 55/323 |
| 5,344,363 | A | * | 9/1994 | Pollock | 454/182 |
| 5,874,292 | A | | 2/1999 | McMinn, Jr. | 435/262 |
| 5,876,276 | A | * | 3/1999 | Arbucci | 454/35 |
| 6,010,558 | A | | 1/2000 | Ackland | 95/141 |
| 6,274,375 | B1 | | 8/2001 | McMinn, Jr. | 435/289.1 |

* cited by examiner

*Primary Examiner*—Derek Boles
(74) *Attorney, Agent, or Firm*—Nawrocki, Rooney & Sivertson, P.A.

(57) ABSTRACT

An apparatus for the collection of contaminants from the exit vent of an air ventilation vent. The apparatus includes a trough adjacent the duct forming the exit vent. The apparatus is constructed and arranged such that no contaminants exiting the vent can pass between the apparatus and the duct. The apparatus may also include a cover placed over the trough. The cover is constructed and arranged to allow contaminants to pass between the duct forming the exit vent and the cover and into the trough.

20 Claims, 4 Drawing Sheets

CONTAMINANT CONTAINMENT STRUCTURE FOR VENTILATION SYSTEMS

BACKGROUND OF THE INVENTION

The present invention relates generally to vents and more particularly, to grease/contaminant containment apparatus for use in conjunction with exit vents.

Vents, particularly powered roof vents, are common on commercial buildings for providing an exit for the ventilation of air from the interior of a building. The air is typically channeled out of the building through duct work. The duct work terminates in an exit vent which is simply an orifice that allows the air to exit the building. An exit vent is typically formed by a duct that extends outward from the surface of the building, with an opening at the end of the duct forming the exit vent.

In some applications, the air to be evacuated is laden with grease or other contaminants. For example, restaurants, use grease in the preparation of food. Some of the grease used escapes into the air within the restaurant and is vented to the exterior of the building, typically by roof vents.

Grease and other contaminants either collect on the sides of the duct forming the vent or exit the vent, along with the air, to settle on surfaces in close proximity to the exit vent. In many situations, there is a contaminant buildup on the exterior of the building around the vent. The primary cause for this being that the contaminants leak out of seams in the fan structure or the linkage between the fan and exit vent structures.

In many instances, vented contaminants are harmful to the building, particularly the roofing surface. Additionally, the contaminants may be flammable and, thereby, create a fire hazard. Under these situations, it is preferred that contaminants be contained and/or collected before they contact the building surfaces.

Traditionally, contaminant collection has involved the use of absorbent pads placed adjacent a roof vent or adjacent to a ventilation fan attached to the duct forming the exit vent. These pads are typically not reusable or recyclable and new pads must periodically be bought and installed. This system is both costly to the environment and to the owner of the ventilation system. Further, although this method collects some of the contaminants, often times the pads are not changed in a timely manner leading to a contaminant buildup. In many instances, the contaminants either flow off the surface of the pad or soak through the pad and onto the surface of the building. In either case, the contaminants come in contact with the surface of the building. Under these circumstances, the pads do not solve the problems of contaminant buildup.

Another proposal to capture and remove contaminants is a trough. However, known structures have a gap between the trough and the surface to which it is attached. The gap allows contaminants to seep through the gap to the exterior surface of the building. In some instances, the trough is not seamless such that contaminants leak through the seams in the trough. In addition to the collection of contaminants, the troughs of the prior art also collect rain water and other debris and, in some cases, the capacity of the trough is not sufficient to hold all of this material, causing an overflow of the trough and onto the surface of the building.

SUMMARY OF THE INVENTION

The present invention provides an apparatus for the capture of heavy contaminants, such as grease, from the roof vent of a building. The apparatus of the present invention includes a trough adjacent the duct forming the exit vent. The trough, and possibly the entire body, may be constructed from a seamless piece of material. It is also preferred that the trough surround the exit vent.

The trough is preferably constructed and arranged such that no contaminants exiting the vent can pass between the trough and the duct surface. For example, in accordance with one embodiment of the present invention, the apparatus includes a flange extending into the exit vent. It is preferred that the flange be attached to the interior surface forming the exit vent and, more preferably, that the attachment of the flange is made such that no contaminants can pass between the flange and the interior surface of the duct forming the exit vent. It is also preferred that the flange is constructed and arranged to surround the exit vent.

The apparatus may also include a trough cover. The cover is attached to the trough such that it allows contaminants to pass between the duct forming the exit vent and the cover, and into the trough. The cover may be formed of a plurality of sections and, more preferably, portions of adjacent cover sections overlap.

DESCRIPTION OF THE PREFERRED EMBODIMENTS

Figure 1:
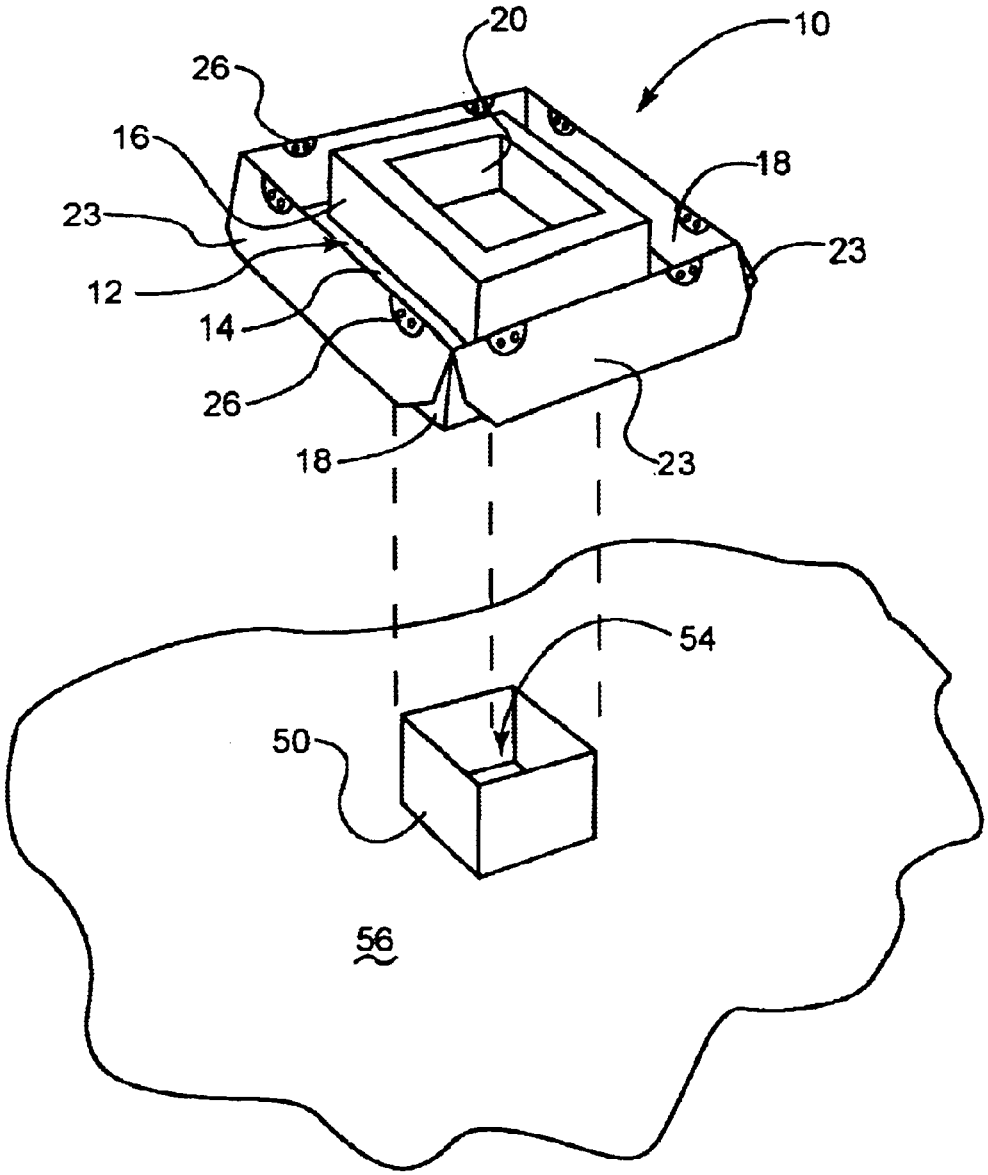
FIG. 1 is an exploded view of an embodiment of a contaminant containment apparatus in constructed in accordance with the present invention.

The present invention provides an apparatus for the capture and containment of heavy contaminants, such as grease, from the exit vent of a building. As shown in FIG. 1, the apparatus 10 generally includes a trough 12 positioned adjacent to a duct 50, forming the exit vent 54 of an air ventilation system (not shown), on the roof 56 of a building.

As shown in FIG. 1, the trough 12 generally includes a bottom 14, an inner wall 16, and an outer wall 18. The trough 12 is preferably constructed such that the bottom 14 of the trough 12 rests against the surface of the roof 56.

Figure 4:
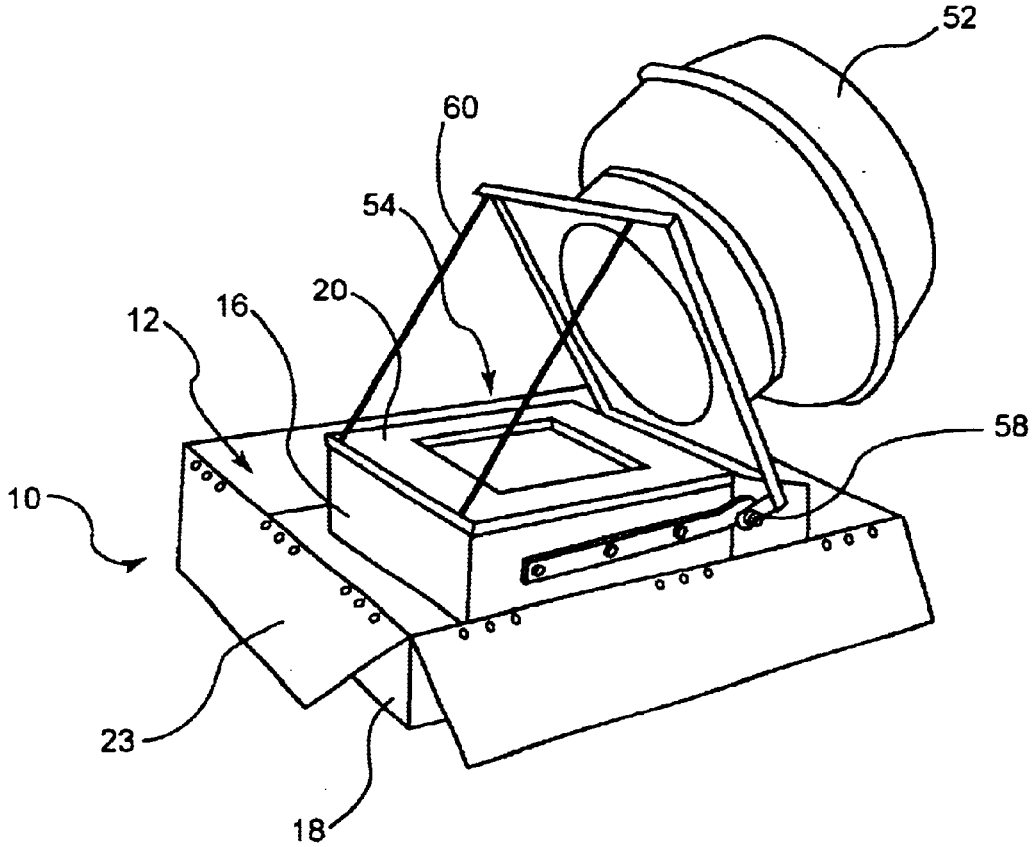
FIG. 4 shows the embodiment of FIG. 2 with its cover sections open and the fan structure pivoted to show the exit vent orifice.

The inner wall 16 is preferably attached to the exterior of the duct 50 such that the no leakage is possible between the duct 50 and the inner wall 16. Alternatively, a flange 20 may extend from the top of the inner wall 16 and into the exit vent 54. The flange 20 may then be attached to the interior surface of the duct 50. When this embodiment is utilized with a fan, the flange 20 will extend between the fan structure 52 and the duct 50 as shown in FIG. 4 and, therefore, attachment of the fan structure 52 must either be made to the surface of the flange 20, or through the flange 20, to the duct 50. Preferably, the attachment of the fan structure 52 would also be made such that no contaminants could leak between the fan structure 52 and the flange 20.

The attachment of the inner wall 16 to the duct 50 and/or the fan structure 52 may be accomplished by any method known in the art. For example, welding the edge or surface of the inner wall 16 to the surface of the duct 50 or to the upper edge of the duct 50. Further, although the walls 16 and 18, bottom 14, and flange 20 may be formed from separate pieces of material, it is preferred that the trough 12 and flange 20 are fabricated from a unitary piece of material. Additionally, the apparatus 10 may be fabricated including the duct 50 that extends out of the building and/or with a fan structure 52 provided thereon. It is also preferred that the trough 12 and/or the flange 20 be fabricated to surround the exit vent 54 so that substantially all of the contaminants exiting the vent 54 can be collected and contained.

The apparatus 10 may also have a cover 22 over the trough 12. In one embodiment, such as the embodiment shown in the Figures, the cover 22 may have a plurality of cover portions 23 for covering the interior of the trough 12, thereby, substantially keeping rain and other debris out of the trough 12. The sections 23 of the cover 22 are preferably sized to extend over nearly the entire opening of the trough 12, but still forming a gap 62 large enough to allow the grease to flow out of the vent 54 and into the trough 12. The gap 62 is located between one edge of a cover section 23 and the inner wall 16 of the trough 12. The size of the gap may vary with the particular use to which the apparatus is to be utilized. For example, in applications where most contaminants will collect on the sides of the duct 50 and flow down the sides of the duct 50 into the trough 12, a smaller gap 62 may be utilized. Also as shown, the sections 23 preferably have the end portion of each section lapping (over or under) the end portion of the adjacent sections.

Figure 2:
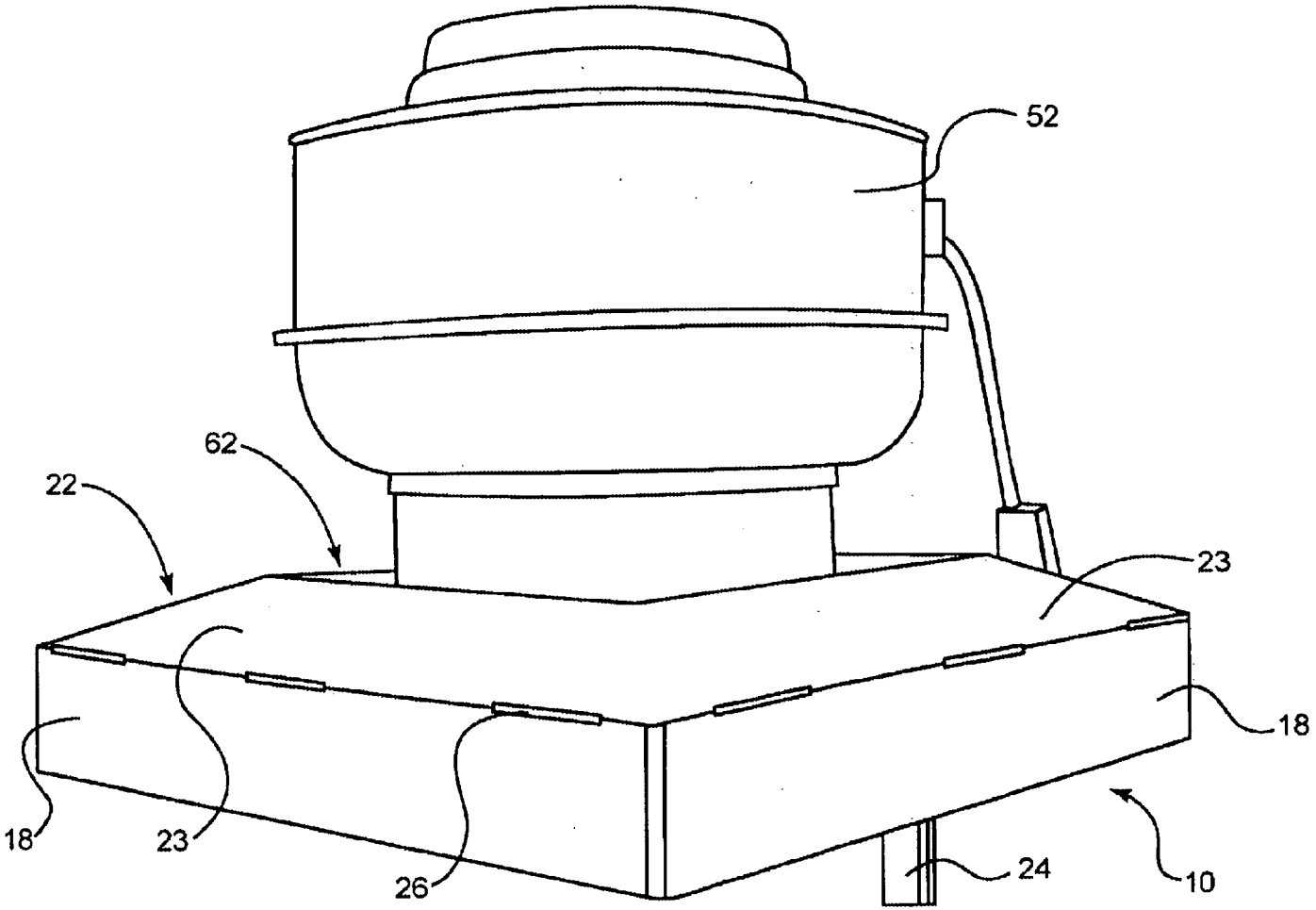
FIG. 2 shows a preferred embodiment of a contaminant containment apparatus constructed in accordance with the present invention mounted to a vent with a fan.
Figure 3:
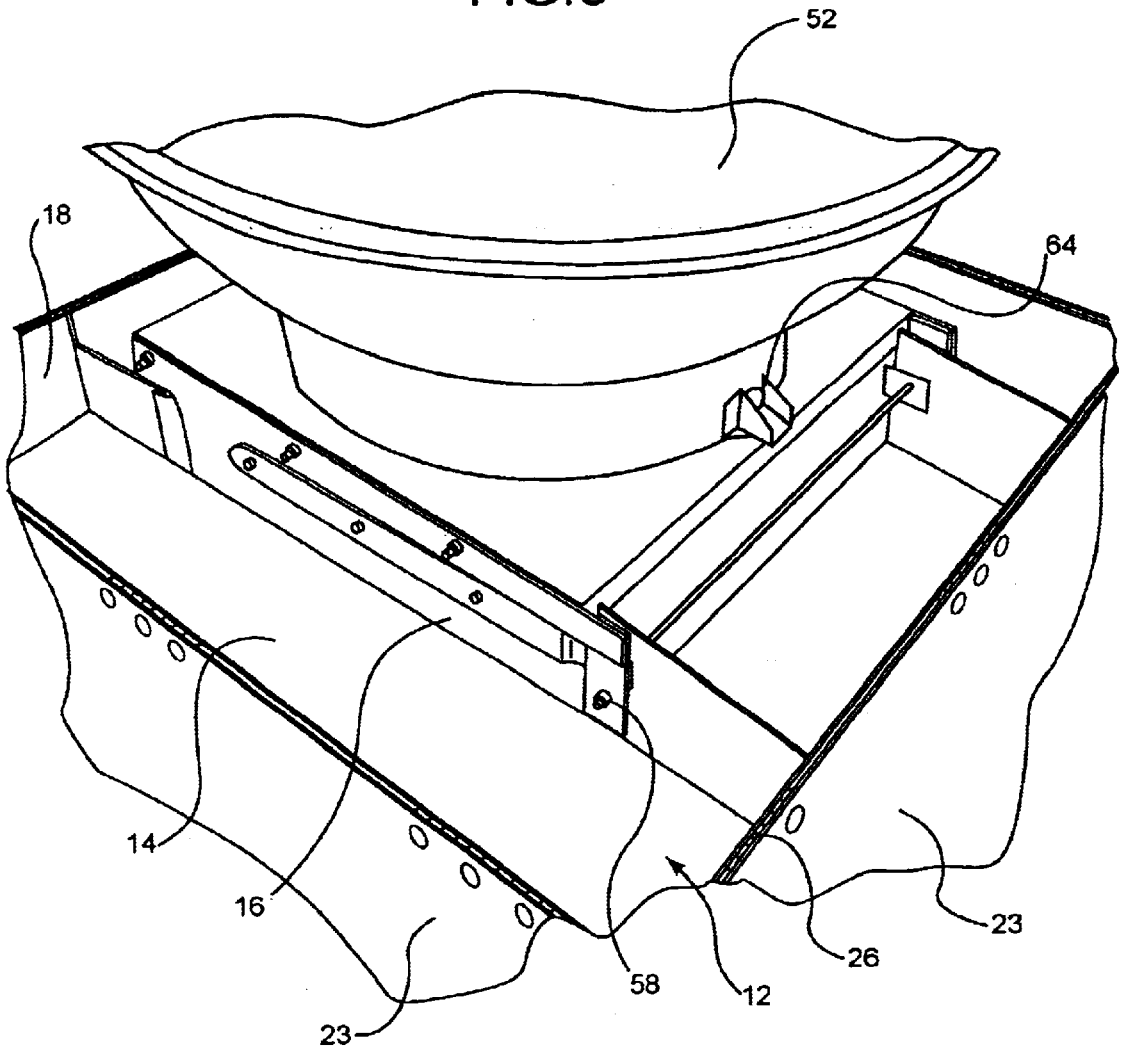
FIG. 3 provides a close up view of a portion of the apparatus of FIG. 2.

In some applications, and as shown in FIG. 1, it may be preferred that the sections 23 of the cover 22 form a pitched covering surface such that the cover 22 is pitched downward generally from the inner wall 16 of the trough 12 to the outer wall 18 to facilitate the shedding of water off of the cover 22. This may be accomplished by any means known in the art. For example, the hinges 26 may be constructed having limited range of movement such that when the sections 23 of the cover 22 are closed, they are positioned at a pitched angle. It is also preferred, as is shown in FIG. 2, that portions of the cover sections 23 that are lapped, are bent to better conform to the surface of the adjacent cover section 23 when the cover sections are pitched.

The cover 22 is preferably movable and may be attached by any suitable mechanism known in the art, for example, by hinges 26 that allow the sections 23 of the cover 22 to be moved out of the way so that the trough 12 can be accessed more easily for cleaning. As shown, the preferred arrangement for attachment of the cover 22 to the trough 12 is for cover sections 23 to be mounted to the outer wall 18 of the trough 12.

Additionally, when a fan structure 52 is utilized, the fan structure 52 may be pivotally mounted to the flange 20, inner wall 16 of the trough 12 as shown in FIG. 4, or to the duct 50. This allows easier access to the exit vent 54 for cleaning and allows access to the bottom of the fan structure 52 for cleaning and maintenance. This pivotal relation may be accomplished by any means known in the art. For example, as shown, the fan structure 52 may be mounted to the inner wall 16 of the trough 12 by one or more hinges 58. In most commercial fan structures, a drain spout 64 is formed in the side of the fan structure to more readily allow contaminants to exit the structure. It is preferred that the hinges 58 allow the fan structure 52 to be tipped in the direction of the drain spout 64. Further, wires 60 may be utilized to hold the fan structure 52 in a pivoted position while work is being done on the apparatus 10. Preferably, the wires 60 are mounted to the exterior surface of the fan structure and to the inner wall 16 of the trough 12. Any suitable material may be utilized to hold the pivoted fan structure, for example, chains, cables, and the like, are suitable materials for this purpose.

In some embodiments, the apparatus 10 has a drain 24 connected to the interior of the building, wherein the contaminants and water, solvent, or other such material that can be used to clean out the trough 12, can be disposed of. This drain 24 may be connected directly to a receptacle that can be used to house the contaminants, and the water, solvent, etc. The receptacle can then be removed from the building for disposal or treatment off site. In this embodiment, the bottom 14 of the trough 12 may be pitched toward the drain 24 to encourage the cleaning material and contaminants to flow toward the drain 24.

If no drain 24 is provided, the trough 12 is preferably sized to accommodate water, solvent, or other such material used to wash out the grease that accumulates in the trough 12 plus any contaminants therein. This allows both the water and the like to be held for disposal. If desired, the trough 12 may be sized to even hold cleaning material and contaminants from cleaning the fan structure 52 and the trough 12.

Although the apparatus 10 may be made of any material, it is preferred that the apparatus be made from a material that will not corrode or become weakened when exposed to weather conditions such as wind, rain, sun, and the like, or from exposure to the contaminants to be contained. One such example of a suitable material for an apparatus utilized for the collection and containment of grease is stainless-steel.

Additionally, although the present invention has been described with reference to preferred embodiments, workers skilled in the art will recognize that changes may be made in form and detail and combinations of one or more features of the embodiments may be made without departing from the spirit and scope of the invention. Further, since many possible embodiments may be made of the present invention without departing from the scope thereof, it is to be understood that all matter herein set forth or shown in the accompanying drawings is to be interpreted in the illustrative and not a limiting sense.

What is claimed is:

1. An apparatus for the collection of contaminants from the exit vent of an air ventilation vent, comprising:

a trough adjacent a duct forming the exit vent; and a cover pivotally mounted to an outer wall of said trough, said cover being constructed and arranged to allow contaminants to pass between the duct forming the exit vent and said cover and into said trough.

2. The apparatus according to claim 1, wherein said trough surrounds the exit vent.

3. The apparatus according to claim 1, wherein said trough is constructed from a seamless piece of material.

4. The apparatus according to claim 1, further comprising a flange extending from said trough and into the exit vent.

5. The apparatus according to claim 4, wherein said flange is attached to an interior surface of the duct forming the exit vent.

6. The apparatus according to claim 5, wherein said attachment of said flange is made such that no contaminants can pass between said flange and the interior surface forming the exit vent.

7. The apparatus according to claim 6, wherein said flange is constructed and arranged to surround the exit vent.

8. An apparatus for the collection of contaminants from the exit vent of an air ventilation vent, comprising:

a trough adjacent and surrounding a duct forming the exit vent, said trough having a flange extending into the exit vent; and a cover over said trough, said cover being constructed and arranged to allow contaminants to pass between the surface forming the exit vent and said cover and into said trough, said cover being connected to said trough by a hinge.

9. The apparatus according to claim 8, wherein said cover is comprised of a plurality of sections.

10. The apparatus according to claim 9, wherein a portion of each said cover section laps a portion of one adjacent section.

11. An apparatus for the collection of contaminants from the exit vent of an air ventilation vent, comprising:

a trough adjacent a duct forming the exit vent said trough being constructed and arranged such that no contaminants exiting said vent can pass between an inner wall of said trough and the vent surface; and a cover mounted to an outer wall of said trough by a hinge, said cover having a closed position wherein said cover is pitched downward from said inner wall of said trough to said outer wall of said trough.

12. The apparatus of claim 11, further comprising a cover over said trough.

13. The apparatus of claim 12, wherein said cover is constructed and arranged to allow contaminants to pass between the surface forming the exit vent and said cover and into said trough.

14. The apparatus according to claim 12, wherein said trough surrounds the exit vent.

15. The apparatus according to claim 14, wherein said trough is constructed from a seamless piece of material.

16. The apparatus according to claim 15, further comprising a flange extending from said trough and into the exit vent.

17. The apparatus according to claim 16, wherein said flange is attached to an interior surface of the duct forming the exit vent.

18. The apparatus according to claim 17, wherein said attachment of said flange is made such that no contaminants can pass between said flange and the interior surface forming the exit vent.

19. The apparatus according to claim 18, wherein said flange is constructed and arranged to surround the duct forming the exit vent.

20. The apparatus according to claim 11, further comprising a fan structure positioned to receive air from the exit vent and pivotally mounted to said trough.

* * * * *